US006412385B1

(12) United States Patent
Willis

(10) Patent No.: US 6,412,385 B1
(45) Date of Patent: Jul. 2, 2002

(54) RESIZING COLLECT DIE

(76) Inventor: Larry A. Willis, 1480 Guinevere Dr., Casselberry, FL (US) 32707

( * ) Notice: Subject to any disclaimer, the term of this patent is extended or adjusted under 35 U.S.C. 154(b) by 0 days.

(21) Appl. No.: 09/835,796

(22) Filed: Apr. 16, 2001

(51) Int. Cl.[7] ..... F42B 33/02

(52) U.S. Cl. ..... 86/24; 86/19.5; 72/370.13; 72/367

(58) Field of Search ..... 86/24, 19.5; 29/1.3; 72/367, 370.13

(56) References Cited

U.S. PATENT DOCUMENTS 2,571,272 A * 10/1951 Martin
3,580,127 A * 5/1971 Lee
3,705,515 A * 12/1972 Lee
3,974,736 A * 8/1976 Minko
4,593,598 A * 6/1986 Ginder
4,723,472 A * 2/1988 Lee
4,732,073 A * 3/1988 Semon
5,079,986 A * 1/1992 Lee
5,221,806 A * 6/1993 Chaney et al.
5,309,813 A * 5/1994 Henley
5,635,661 A * 6/1997 Tuftee
5,649,465 A * 7/1997 Beebe

* cited by examiner

*Primary Examiner*—Michael J. Carone
*Assistant Examiner*—Troy Chambers

(57) ABSTRACT

An apparatus for fully resizing the base of belted magnum cartridge cases, which is comprised of a threaded tube that is secured to the head of a reloading press. This threaded tube utilizes a collet that fits over most belted cartridge casings. This collet is then pressed into the bore of the threaded tube so that the outside diameter, at the base of the cartridge casing, can be reduced to the size that it was before being fired.

4 Claims, 2 Drawing Sheets

RESIZING COLLECT DIE

BACKGROUND OF THE INVENTION

1. Field of the invention

This invention relates in general to an apparatus that provides more complete resizing of belted magnum cartridge cases after the conventional resizing process has been performed. More particularly, this invention relates to an apparatus that can substantially resize the outside diameter just above the belted portion on belted magnum cartridge cases, that expands in the firing process, beyond the dimension that can be properly resized by using conventional resizing dies alone.

2. Discussion of the Related Art

Many hunters and long range shooters reload their ammunition to gain more power and accuracy while saving money on ammunition, compared to buying factory loaded ammunition. A reloading press is typically used for this purpose. The press contains a stationary head for supporting one or more dies used in the reloading process and a vertical, moveable ram for moving cartridges in and out of the dies. After a cartridge is fired, the entire cartridge case expands from the pressure generated by the burning propellant. Therefore, one important function of the reloading process is to fully resize the cartridge case.

One long existing and well known problem with resizing dies of the past is that they can not completely resize belted magnum cartridge cases in the area just above the belt. Commercial ammunition is therefore only able to be resized one or two times before this area above the belt expands too much for a conventional resizing die to work. This results in expensive cartridges cases that are rendered useless long before they should be.

SUMMARY OF THE INVENTION

This is a resizing die that overcomes the major problem involved in reloading belted magnum cartridge cases. This belted magnum resizing collet die is needed as a final procedure when reloading belted magnum cartridge cases. It provides the only way to compress fired belted magnum casings far enough to allow several extra reloadings. This makes reloading economically practical for several different cartridge cases that use the belted magnum design. This resizing die also has an opening at the top, for inserting cartridges, that serves as a gauge to determine which cartridge cases require the use of the collet die.

DETAILED DESCRIPTION OF THE PREFERRED EMBODIMENTS

Figure 1:
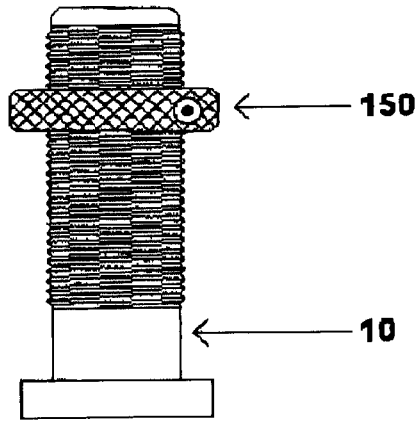
FIG. 1 is a side view of the threaded die.

Referring now to the drawings, which are for the purpose of illustrating the preferred embodiment of the invention and not for the purpose of limiting the same, drawn items in FIG. 1 show the threaded resizing die and collet of the present invention.

Figure 2:
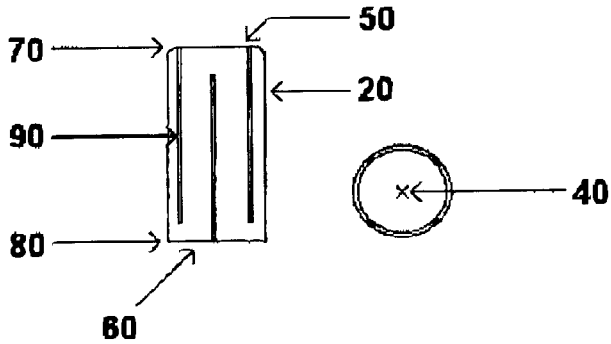
FIG. 2 is a side view of the collet.

FIG. 2 shows a belted magnum cartridge case for clarification in describing the function of the resizing die in FIG. 1.

The resizing die in FIG. 1 is suitable for use in a conventional reloading press buy inserting the resizing die in FIG. 1 from the bottom of the fixed head of the reloading press (not shown). The locking collar FIG. 1-2 is then used to secure the optimum vertical position of the die when threaded into the press. The press is constructed with a stationary head (not shown) and a vertical moveable ram, which holds a cartridge holder on top of the ram, which is secured in a slotted opening. A cartridge holder is mounted on the top surface of the ram, which has a slotted opening formed therein that is gauged to receive the rim FIG. 2-7 of the belted magnum cartridge case so as to support the cartridge case FIG. 2 in a vertical center line beneath the resizing die FIG. 1-3. Other means of securing the resizing die in FIG. 1 are possible, as will be recognized by one skilled in the art.

To operate the resizing die in FIG. 1 the belted magnum cartridge case FIG. 2 is then inserted into the bottom of the collet FIG. 1-4 and then properly seated on the ram. The vertical centerline of the cartridge case FIG, 2, the collet and resizing die in FIG. 1 are concentric, and will remain so as the ram moves toward the resizing die in FIG. 1. The outside surface of the collet in FIG. 1 must be lubricated with a suitable high pressure lubricant before the cartridge case FIG. 2 and collet in FIG. 1 are pressed into the tapered resizing die in FIG. 1. This operation causes a compression of the cartridge case FIG. 2 inside the collet in FIG. 1. This procedure is required after the belted magnum cartridge case FIG. 2 has been resized in the conventional fashion. Every time a cartridge case is fired, the area just above the belt FIG. 2-5 expands a few thousandths of an inch. One difficulty in reloading belted magnum cartridge cases is that conventional resizing dies are not able to fully compress the cartridge casings just above the horizontal expanded belt FIG. 2-4 on belted magnum cartridge cases.

The top of the resizing die has a vertical, tapered through hole FIG. 1-1 that allows the operator to insert an inverted belted magnum cartridge case FIG. 2 and use the top of the resizing die FIG. 1-1 as a gauge, to see if the final resizing procedure is needed. The goal is to resize the outside wall of the cartridge case just above the belt FIG. 2-6 after being resized in a conventional resizing die. The extra resizing in this area FIG. 2-6 will allow the belted magnum cartridge cases FIG. 2 to be reloaded several times more than previously possible.

While this invention has been described in detail with reference to a preferred embodiment, it should be appreciated that the present invention is not limited to that precise embodiment. Rather, in view of the present disclosure, which describes the best mode for operating the invention, many modifications and variations would present themselves to those of skill in the art without departing from the scope and spirit of this invention, as defined in the claims.

What is claimed is:

1. An apparats for the resizing of a spent ammunition cartridges, comprising:

an elongated substantially cylindrical element having an internal bore there through having a central axis and adapted to receive said spent ammunition cartridge, an upper radial portion having a first radius and a first means for radial compression, a lower radial portion having a second radius and a second means for radial compression, wherein the first radius is slightly less than the second radius, thereby forming a longitudinal taper between said upper radial portion and said lower radial portion;

an elongated substantially cylindrical receiving element having an upper end;

a lower end;

an interior defined by an axial opening extending there through;

said opening configured to receive said elongated cylindrical element;

an exterior defined by treaded means located along a portion of the elongated exterior of said receiving element; and and eternal compression means so that when said ammunition cartridge is placed within said elongated cylindrical element and said elongated cylindrical element is placed within said elongated receiving element, the resulting forces cause said upper and lower radial positions to compress toward said central axis resulting in a resizing of said ammunition cartridge.

2. The apparatus of claim 1 wherein the first means of radial compression comprise a plurality of slots extending from a position adjacent to said upper radial portion and extending a longitudinal distance toward said lower radial portion.

3. The apparatus of claim 1 wherein the second means of radial deflection comprise a plurality of slots extending from a position adjacent to said lower radial portion and extending a longitudinal distance toward said upper radial portion.

4. A method of resizing a spent ammunition cartridge, comprising:

providing an elongated substantially cylindrical element having an internal bore there through having a central axis and adapted to receive said spent ammunition cartridge, an upper radial portion having a first radius and a first means for radial compression, a lower radial portion having a second radius and a second means for radial compression, wherein the first radius is slightly less than the second radius, thereby forming a longitudinal taper between ad upper radial portion and said lower radial portion, providing an elongated receiving element having an interior defined by internal bore there through adapted to receive said elongated cylindrical element, an exterior defined by threaded means located along a portion of the elongated exterior of said receiving element, placing said spent ammunition cartridge within said internal bore of said elongated substantially cylindrical element, placing said elongated substantially cylindrical element within said elongated receiving element; and, applying an external compression means so that when said ammunition cartridge is placed within said elongated cylindrical element and said elongated cylindrical element is placed within said elongated receiving elements the resulting forces causes said radial portions to compress toward said central axis resulting in a resizing of said ammunition cartridge.

* * * * *

UNITED STATES PATENT AND TRADEMARK OFFICE

CERTIFICATE OF CORRECTION

PATENT NO. : 6,412,385 B1
DATED : July 2, 2002
INVENTOR(S) : Willis

It is certified that error appears in the above-identified patent and that said Letters Patent is hereby corrected as shown below:

Please delete columns 1-4 and substitute columns 1-4 as per attached.

Signed and Sealed this

Sixth Day of May, 2003

JAMES E. ROGAN
*Director of the United States Patent and Trademark Office*

RESIZING COLLET DIE

BACKGROUND OF INVENTION

1. Field of the Invention

This invention relates in general to an apparatus that provides more complete resizing of belted magnum cartridge cases after the conventional resizing process has been performed. More particularly, this invention relates to an apparatus that can substantially resize the outside diameter just above the belted portion on belted magnum cartridge cases that expands in the firing process beyond the dimension that can be properly resized by using conventional resizing dies alone.

2. Discussion of the Related Art

Many hunters and long range shooters reload their ammunition to gain more power and accuracy while saving money on ammunition, compared to buying factory loaded ammunition. A reloading press is typically used for this purpose. The press contains a stationary head for supporting one or more dies used in the reloading process and a vertical, moveable ram for moving cartridges in and out of the dies. After a cartridge is fired, the entire cartridge case expands from the pressure generated by the burning propellant. Therefore, one important function of the reloading process is to fully resize the cartridge case. One long existing and well known problem with resizing dies of the past is that they cannot completely resize belted magnum cartridge cases in the area just above the belt. Commercial ammunition is therefore only able to be resized one or two times before thus area above the belt expands too much for a conventional resizing die to work. Thus results in expensive cartridge cases that are rendered useless long before they should be.

SUMMARY OF INVENTION

This is a resizing die that overcomes the major problem involved in reloading belted magnum cartridge cases. This belted magnum collet resizing die is needed as a final procedure when resizing belted magnum cartridge cases. It provides the only way to compress fired belted magnum casings far enough to allow several extra loadings. Thus makes reloading economically practical for several different cartridge cases that use the belted magnum design. This resizing die also has an opening at the top, for inserting cartridges, that serves as a gauge to determine which cartridge cases require the use of the collet die.

DESCRIPTION OF THE DRAWING

FIG. 1 is a side view of the threaded die.

FIG. 2 is a side view of the collet.

Figure 3:
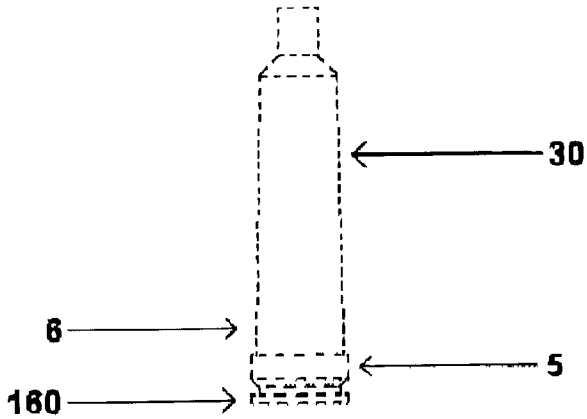
FIG. 3 is a side shadow view of a cartridge.

FIG. 3 is a side shadow view of a cartridge.

Figure 4:
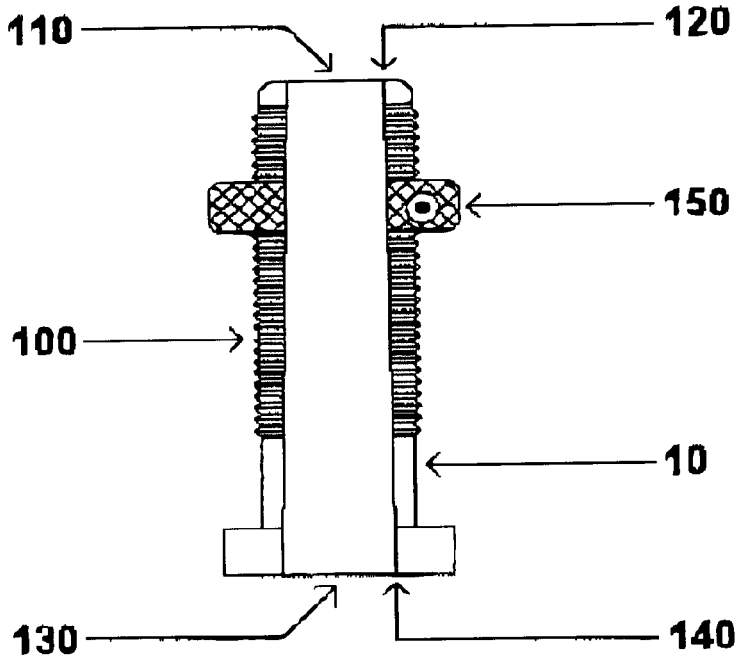
FIG. 4 is a cut out view of the threaded die of FIG. 1.

FIG. 4 is a cut out view of the threaded die of FIG. 1.

DETAILED DESCRIPTION OF THE PREFERRED EMBODIMENTS

Referring now to the drawings, which are the purpose of illustrating the preferred embodiment of the invention and not for the purpose of limiting the same, drawn items in FIGS. 1 and 2 show the threaded resizing die 10 and collet 20 of the present invention. FIG. 3 shows a belted magnum Cartridge case 30 for clarification in describing the function of the resizing die 10 in FIG. 1. The resizing die 10 in FIG. 1 is suitable for use in a conventional reloading press (not shown) by inserting the resizing die 10 in FIG. 1 from the bottom of the fixed head of the reloading press.

The collet 20 is an elongated cylindrical element having an interior defined by an internal through bore 40. Collet 20 has an upper radial portion 50 and a lower radial portion 60. The upper radial portion 50 has a first outer radius 70 and the lower radial portion 60 has a second outer radius 80. The first outer radius 70 is slightly smaller than the second outer radius 80 such that a longitudinal taper exists between the upper and lower radial portions. The collet 20 further includes a plurality of slots 90 located adjacent to each radial portion and extending longitudinally as seen in FIG. 2.

The threaded die 10 is a receiving element defined by a cylinder having a substantially threaded exterior 100 and an interior defined by internal bore there through. The cylinder includes an upper end 110 having a first inside diameter 120 and a lower end 130 having a second inside diameter 140. The first diameter 120 is slightly smaller than the second diameter 140 such that a slight interior longitudinal taper exists between the two ends.

The locking collar 150 is then used to secure the optimum vertical position of the die 10 when threaded into the press. The press is constructed with a stationary head (not shown) and a vertical moveable ram, which holds a cartridge holder on top of the ram which is secured in a slotted opening. A cartridge holder is mounted on the top surface of the ram, which has a slotted opening formed therein that is gauged to receive a rim 160 of the belted magnum cartridge case 30 so as to support the cartridge case 30 in a vertical center line beneath the resizing die 10. Other means of securing the resizing die 10 in FIG. 1 are possible, as will be recognized by one skilled in the art.

To operate the resizing die 10 in FIG. 1 the belted magnum cartridge case 30 is then inserted into the bottom of the collet 20 and then properly seated on the ram. The vertical centerline of the cartridge case 30, the collet 20 and resizing die 10 in FIG. 1 are concentric, and will remain so as the ram moves toward the resizing die 10. The outside surface of the collet 20 in FIG. 2 must be lubricated with a suitable high-pressure lubricant before the cartridge case 30 and collet 20 are pressed into the tapered resizing die 10. Thus operation causes a compression of the cartridge case 30 inside the collet 20. This procedure is required after the belted magnum cartridge case 30 has been resized in the conventional fashion. Every time a cartridge case 30 is fired, the area just above the belt 5 expands a few thousandths of an inch. One difficulty in reloading belted magnum cartridge cases is that conventional resizing dies are not able to fully compress the cartridge case 30 just above the horizontal belt 5 on belted magnum cartridge cases.

The top of the resizing die 10 has a vertical, tapered through hole that allows the operator to insert an inverted belted magnum cartridge case 30 and use the top 110 of the resizing die 20 as a gauge, to see if the final resizing procedure is needed. The goal is to resize the outside wall 6 of the cartridge case 30 just above the belt 5. The extra resizing in the outside wall 6 will allow the belted magnum cartridge case 30 to be reloaded several times more than previously possible.

While thus invention has been described in detail with reference to a preferred embodiment, it should be appreciated that the present invention is not limited to that precise embodiment. Rather in view of the present disclosure, which describes the best mode for operating the invention, many modifications and variations would present themselves to those of skill in the art without departing from the scope and spirit of thus invention, as defined in the claims.

What is claimed is:

1. An apparatus for the resizing of a spent ammunition cartridges, comprising:

an elongated substantially cylindrical element having an internal bore there through having a central axis and adapted to receive said spent ammunition cartridge, an upper radial portion having a first radius and a first means for radial compression, a lower radial portion having a second radius and a second means for radial compression, wherein the first radius is slightly less than the second radius, thereby forming a longitudinal taper between said upper radial portion and said lower radial portion;

an elongated substantially cylindrical receiving element having an upper end;

a lower end;

an interior defined by an axial opening extending there through;

said opening configured to receive said elongated cylindrical element;

an exterior defined by threaded means located along a portion of the elongated exterior of said receiving element; and and external compression means so that when said ammunition cartridge is placed within said elongated cylindrical element and said elongated cylindrical element is placed within said elongated receiving element, the resulting forces cause said upper and lower radial positions to compress toward said central axis resulting in a resizing of said ammunition cartridge.

2. The apparatus of claim 1 wherein the first means of radial compression comprise a plurality of slots extending from a position adjacent to said upper radial portion and extending a longitudinal distance toward said lower radial portion.

3. The apparatus of claim 1 wherein the second means of radial deflection comprise a plurality of slots extending from a position adjacent to said lower radial portion and extending a longitudinal distance toward said upper radial portion.

4. A method of resizing a spent ammunition cartridge, comprising:

providing an elongated substantially cylindrical element having an internal bore there through having a central axis and adapted to receive said spent ammunition cartridge, an upper radial portion having a first radius and a first means for radial compression, a lower radial portion having a second radius and a second means for radial compression, wherein the first radius is slightly less than the second radius, thereby forming a longitudinal taper between said upper radial portion and said lower radial portion, providing an elongated receiving element having an interior defined by internal bore there through adapted to receive said elongated cylindrical element, an exterior defined by threaded means located along a portion of the elongated exterior of said receiving element, placing said spent ammunition cartridge within said internal bore of said elongated substantially cylindrical element, placing said elongated substantially cylindrical element within said elongated receiving element; and, applying an external compression means so that when said ammunition cartridge is placed within said elongated cylindrical element and said elongated cylindrical element is placed within said elongated receiving element, the resulting forces causes said radial potions to compress toward said central axis resulting in a resizing of said ammunition cartridge.

* * * * *